US009701003B2

(12) United States Patent
Moore

(10) Patent No.: US 9,701,003 B2
(45) Date of Patent: Jul. 11, 2017

(54) HYDRAULIC HAMMER HAVING DELAYED AUTOMATIC SHUTOFF

(71) Applicant: Caterpillar Inc., Peoria, IL (US)

(72) Inventor: Cody Moore, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 532 days.

(21) Appl. No.: 14/285,780

(22) Filed: May 23, 2014

(65) Prior Publication Data

US 2015/0336256 A1 Nov. 26, 2015

(51) Int. Cl.

| | |
|---|---|
| ***B25D 9/12*** | (2006.01) |
| ***B25D 9/26*** | (2006.01) |
| ***B25D 9/14*** | (2006.01) |
| ***E02F 3/96*** | (2006.01) |
| ***B25D 9/18*** | (2006.01) |
| *E02F 9/22* | (2006.01) |
| *B25D 9/16* | (2006.01) |
| *F15B 13/02* | (2006.01) |
| *F15B 11/042* | (2006.01) |

(52) U.S. Cl.

CPC ..... *B25D 9/265* (2013.01); *B25D 9/12* (2013.01); *B25D 9/145* (2013.01); *B25D 9/18* (2013.01); *E02F 3/966* (2013.01); *B25D 9/16* (2013.01); *E02F 9/2267* (2013.01); *F15B 11/042* (2013.01); *F15B 13/024* (2013.01)

(58) Field of Classification Search

CPC .... B25D 11/106; B25D 16/006; B25D 17/00; B25D 9/12; B25D 9/16; B25D 9/265; B25D 9/145; B25D 9/26; B25D 9/14; E02F 9/2217; E02F 9/221; E02F 9/222; E02F 9/2203; E02F 9/2267; E02F 3/966; F15B 1/024; F15B 11/042; F15B 13/024

USPC ..... 173/1, 91, 114, 115, 168, 200, 13, 177, 173/135, 206, 207, 208; 91/277, 321, 91/323, 300, 290

See application file for complete search history.

(56) References Cited

U.S. PATENT DOCUMENTS

| | | | | |
|---|---|---|---|---|
| 3,241,622 A | | 3/1966 | Ottoson et al. | |
| 3,942,322 A | * | 3/1976 | Hammarstrand | B25D 9/12 60/371 |
| 4,281,587 A | | 8/1981 | Garcia-Crespo | |
| 4,552,227 A | | 11/1985 | Wohlwend | |
| 4,899,836 A | * | 2/1990 | Vernot | B25D 9/26 173/207 |
| 5,174,387 A | * | 12/1992 | Arndt | E02F 3/966 173/1 |

(Continued)

*Primary Examiner* — Scott A. Smith
(74) *Attorney, Agent, or Firm* — Law Office of Kurt I. Fugman LLC

(57) ABSTRACT

An automatic shutoff system for a hydraulic hammer is disclosed. The automatic shutoff system may include an inlet groove formed around a piston associated with the hydraulic hammer and configured to receive pressurized fluid, and an outlet groove formed around a piston associated with the hydraulic hammer and configured to discharge the pressurized fluid. The automatic shutoff system may also include an annular passage configured to allow the pressurized fluid to flow between the inlet and outlet grooves. The automatic shutoff system may further include a valve disposed upstream of the inlet groove and configured to selectively block the pressurized fluid from flowing into the inlet groove based on an operational state of the hydraulic hammer.

20 Claims, 4 Drawing Sheets

(56) References Cited

U.S. PATENT DOCUMENTS

| | | | | |
|---|---|---|---|---|
| 5,860,481 | A * | 1/1999 | Prokop | B25D 9/14 173/17 |
| 5,893,419 | A * | 4/1999 | Hodges | B25D 9/12 173/13 |
| 6,334,495 | B2 * | 1/2002 | Deimel | B25D 9/265 173/115 |
| 6,491,114 | B1 * | 12/2002 | Webel | E02F 3/966 173/11 |
| 6,672,403 | B2 * | 1/2004 | Ahr | B25D 9/265 173/1 |
| 6,959,967 | B1 | 11/2005 | Prokop et al. | |
| 7,779,930 | B2 | 8/2010 | Lohmann et al. | |
| 8,151,900 | B2 * | 4/2012 | Piras | B25D 9/145 137/625 |
| 8,939,227 | B2 * | 1/2015 | Theobalds | B25D 9/12 173/1 |
| 2002/0185285 | A1 | 12/2002 | Ahr et al. | |
| 2009/0090525 | A1 * | 4/2009 | Juvonen | B25D 9/145 173/1 |
| 2012/0160528 | A1 | 6/2012 | Theobalds | |

* cited by examiner

HYDRAULIC HAMMER HAVING DELAYED AUTOMATIC SHUTOFF

TECHNICAL FIELD

The present disclosure is directed to a hydraulic hammer and, more particularly, to a hydraulic hammer having a delayed automatic shutoff.

BACKGROUND

Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid in the hydraulic system is supplied to the hammer to drive a reciprocating piston in contact with a work tool, which in turn causes the work tool to reciprocate while in contact with the construction material.

In some applications, the hydraulic hammer may be equipped with an automatic shutoff that locks the piston in a downward position when the work tool is no longer in contact with the construction material (e.g., breaks through the construction material). The automatic shutoff stops the piston from continuing to drive the work tool further into broken construction material, without requiring operator intervention. As a result, the automatic shutoff prevents unnecessary machine movement and provides more accurate control.

An exemplary automatic shutoff device for a hydraulic hammer is disclosed in U.S. Pat. No. 4,281,587 (the '587 patent) that issued to Garcia-Crespo on Aug. 4, 1981. Specifically, the '587 patent discloses a hydraulic hammer having an automatic stopping device that allows the hammer to operate only when a tool is set against a workpiece, and stops operation of the hammer when the tool is taken away from the workpiece. The automatic stopping device includes a plunger that descends to its lowest operating position when the tool is not set against the workpiece. While in this position, an automatic stopping port is uncovered and pressurized fluid is allowed to bypass to a discharge line, thereby preventing upward movement of the plunger. To begin hammer operation again, the tool is set against the workpiece, causing enough upward force to move the plunger upward a distance to block the automatic stopping port, allowing the plunger to continue reciprocating.

Although the automatic stopping device of the '587 patent may be adequate for some applications, it may still be less than optimal. In particular, the automatic stopping device of the '587 patent requires significant machine force (e.g., weight) to press its work tool into the workpiece, such that it causes a reaction force that moves the plunger upward a distance to block the automatic stopping port. This force can typically only be provided by larger machines. Many smaller machines, however, do not have sufficient weight and/or power, and their hydraulic hammers are consequently stuck in the automatic stopping position. In these situations, an operator is required to manually switch off the automatic stopping device and/or discontinue use of the automatic stopping device, resulting in operating efficiencies and wasted downtime.

The disclosed system is directed to overcoming one or more of the problems set forth above and/or other problems of the prior art.

SUMMARY

In one aspect, the present disclosure is directed to an automatic shutoff system for a hydraulic hammer. The automatic shutoff system may include an inlet groove formed around a piston associated with the hydraulic hammer and configured to receive pressurized fluid, and an outlet groove formed around the piston associated with the hydraulic hammer and configured to discharge the pressurized fluid. The automatic shutoff system may also include an annular passage configured to allow the pressurized fluid to flow between the inlet and outlet grooves. The automatic shutoff system may further include a valve disposed upstream of the inlet groove and configured to selectively block the pressurized fluid from flowing into the inlet groove based on an operational state of the hydraulic hammer.

In another aspect, the present disclosure is directed to a method of operating a hydraulic hammer. The method may include receiving pressurized fluid at an inlet groove, and discharging the pressurized fluid from an outlet groove. The method may also include selectively blocking a flow of the pressurized fluid between the inlet and outlet grooves based on an operational state of the hydraulic hammer.

In yet another aspect, the present disclosure is directed to a hydraulic hammer system. The hydraulic hammer system may include a piston, a sleeve disposed external and co-axial to the piston, and a plurality of inlet passages formed within the sleeve and configured to receive pressurized fluid. The hydraulic hammer system may also include an automatic shutoff system configured to delay an automatic shutoff operation based on an operational state of the hydraulic hammer.

DETAILED DESCRIPTION

Figure 1:
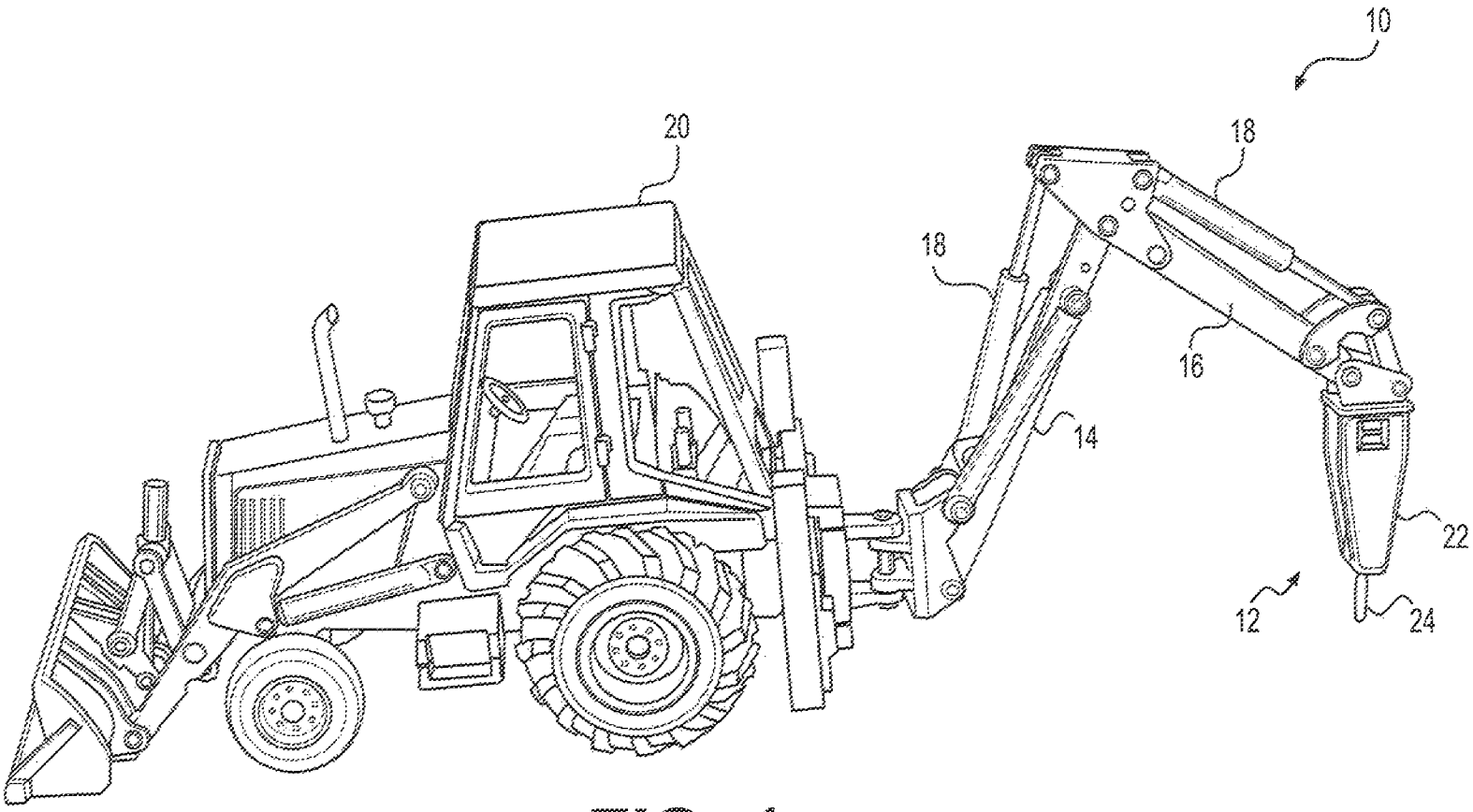
FIG. 1 is a pictorial illustration of an exemplary disclosed machine.

FIG. 1 illustrates an exemplary disclosed machine 10 having a hammer 12. Machine 10 may be configured to perform work associated with a particular industry such as, for example, mining or construction. Machine 10 may be a backhoe loader (shown in FIG. 1), an excavator, a skid steer loader, or any other machine. Hammer 12 may be pivotally connected to machine 10 through a boom 14 and a stick 16. However, it is contemplated that another linkage arrangement may alternatively be utilized, if desired.

In the disclosed embodiment, one or more hydraulic cylinders 18 may raise, lower, and/or swing boom 14 and stick 16 to correspondingly raise, lower, and/or swing hammer 12. The hydraulic cylinders 18 may be connected to a hydraulic supply system (not shown) within machine 10. Specifically, machine 10 may include a pump (not shown) connected to hydraulic cylinders 18 and to hammer 12 through one or more hydraulic supply lines (not shown). The hydraulic supply system may introduce pressurized fluid, for example oil, from the pump into the hydraulic cylinders 18 and hammer 12. Operator controls for movement of hydraulic cylinders 18 and/or hammer 12 may be located within a cabin 20 of machine 10.

Figure 2:
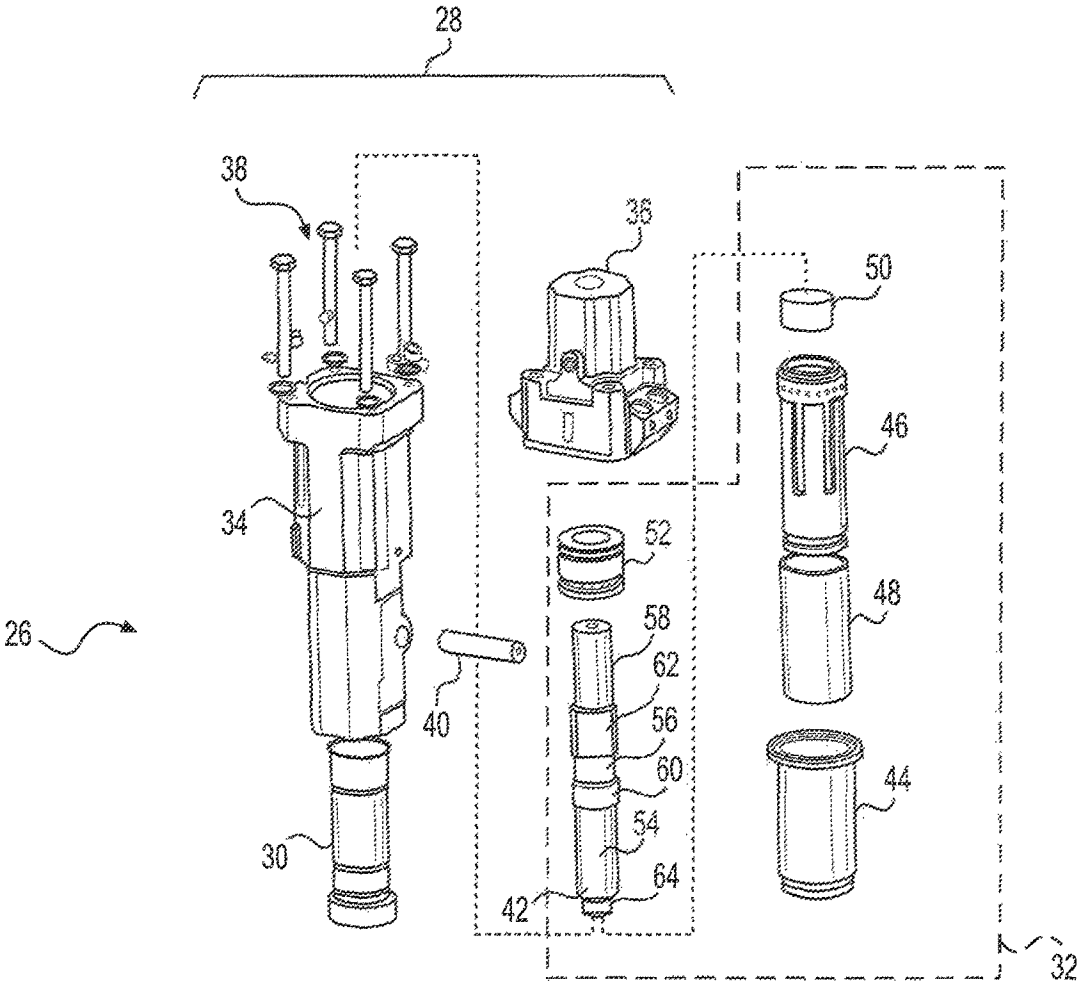
FIG. 2 is an exploded view of an exemplary disclosed hydraulic hammer assembly that may be used with the machine of FIG. 1.

As shown in FIGS. 1 and 2, hammer 12 may include an outer shell 22 and an actuator assembly 26 located within outer shell 22. Outer shell 22 may connect actuator assembly 26 to stick 16 and provide protection for actuator assembly 26. A work tool 24 may be operatively connected to an end of actuator assembly 26 opposite stick 16. It is contemplated that work tool 24 may include any known tool capable of interacting with hammer 12. In one embodiment, work tool 24 includes a chisel bit.

As shown in FIG. 2, actuator assembly 26 may include a subhousing 28, a bushing 30, and an impact system 32. Subhousing 28 may include, among other things, a frame 34 and a head 36. Frame 34 may be a hollow cylindrical body having one or more flanges or steps along its axial length. Head 36 may cap off one end of frame 34. Specifically, one or more flanges on head 36 may couple with one or more flanges on frame 34 to provide a sealing engagement. One or more fastening mechanisms 38 may rigidly attach head 36 to frame 34. In some embodiments, fastening mechanisms 38 may include, for example, screws, nuts, bolts, or any other means capable of securing the two components. Additionally, frame 34 and head 36 may each include holes to receive fastening mechanisms 38.

Bushing 30 may be disposed within a tool end of subhousing 28 and may be configured to connect work tool 24 to impact system 32. A pin 40 may connect bushing 30 to work tool 24. When displaced by hammer 12, work tool 24 may be configured to move a predetermined axial distance within bushing 30.

Impact system 32 may be disposed within an actuator end of subhousing 28 and be configured to move work tool 24 when supplied with pressurized fluid. As shown by the dotted lines in FIG. 2, impact system 32 may be an assembly including a piston 42, an accumulator membrane 44, a sleeve 46, a sleeve liner 48, a valve 50, and a seal carrier 52. Sleeve liner 48 may be assembled within accumulator membrane 44, sleeve 46 may be assembled within sleeve liner 48, and piston 42 may be assembled within sleeve 46. All of these components may be generally co-axial with each other. In addition, piston 42, sleeve 46, valve 50, and seal carrier 52 may all be held together as a sub-assembly by way of slip-fit radial tolerances. For example, slip-fit radial tolerances may be formed between sleeve 46 and piston 42, and between seal carrier 52 and piston 42. Sleeve 46 may apply an inward radial pressure on piston 42, and seal carrier 52 may apply an inward radial pressure on piston 42. Such a configuration may hold sleeve 46, seal carrier 52, and piston 42 together as a sub-assembly.

Accumulator membrane 44 may form a cylindrical tube configured to hold a sufficient amount of pressurized fluid for hammer 12 to drive piston 42 through at least one stroke. Accumulator membrane 44 may be radially spaced apart from sleeve 46 when accumulator membrane 44 is in a relaxed state (i.e. not under pressure from pressurized gas). However, when accumulator membrane 44 is under pressure from the pressurized gas, no spacing may exist between accumulator membrane 44 and sleeve 46, and fluid flow therebetween may be inhibited.

Valve 50 may be assembled over an end of piston 42 and located radially inward of both sleeve 46 and seal carrier 52. A portion of seal carrier 52 may axially overlap with sleeve 46. Additionally, valve 50 may be disposed axially external to accumulator membrane 44. Valve 50 and seal carrier 52 may be located entirely within head 36. Accumulator membrane 44, sleeve 46, and sleeve liner 48 may be located within frame 34. Head 36 may be configured to close off an end of sleeve 46 when connected to frame 34.

Piston 42 may be configured to slide within both frame 34 and head 36. For example, piston 42 may be configured to reciprocate within frame 34 and contact an end of work tool 24. Specifically, a compressible gas (e.g., nitrogen gas) may be disposed in a gas chamber (not shown) located within head 36 at an end of piston 42 opposite bushing 30. Piston 42 may be slideably moveable within the gas chamber to increase and decrease the size of the gas chamber. A decrease in size of the gas chamber may increase the gas pressure within the gas chamber, thereby driving piston 42 downward to contact work tool 24.

Piston 42 may comprise varying diameters along its length, for example one or more narrow diameter sections disposed axially between wider diameter sections. In the disclosed embodiment, piston 42 includes three narrow diameter sections 54, 56, 58, separated by two wide diameter sections 60, 62. Narrow diameter sections 54, 56, 58 may cooperate with sleeve 46 to selectively open and close fluid pathways within sleeve 46. Piston 42 may further include an impact end 64 having a smaller diameter than any of narrow diameter sections 54, 56, 58. Impact end 64, may be configured to contact work tool 24 within bushing 30.

Figure 3:
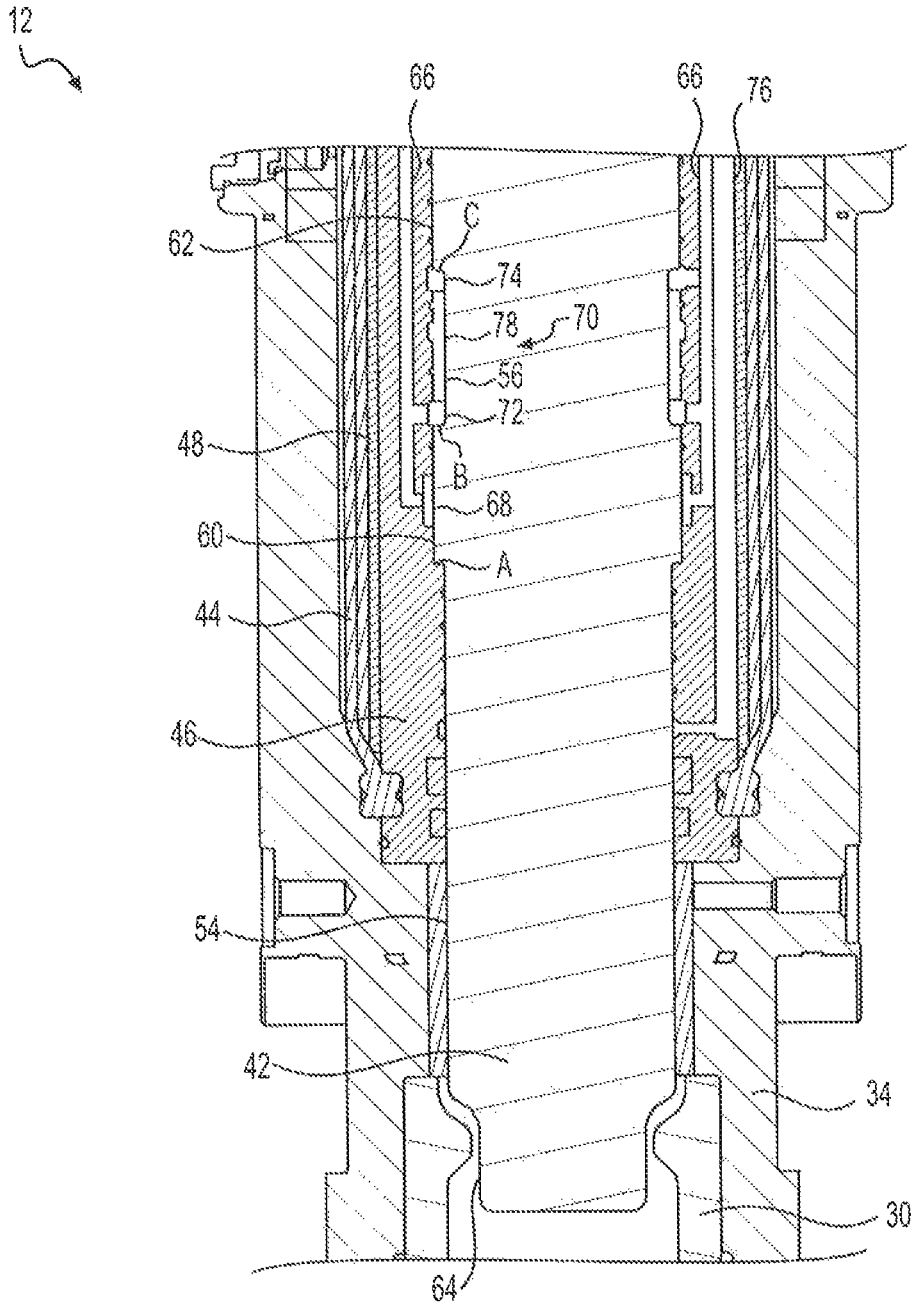
FIG. 3 is a cross-sectional illustration of an exemplary disclosed automatic shutoff system that may be used with the hydraulic hammer of FIG. 2.

As shown in FIG. 3, one or more fluid passages may be formed within sleeve 46 and configured to direct pressurized fluid within hammer 12 to move piston 42. For example, one or more inlet passages 66 may extend from an inlet port (not shown) formed within head 36 to one or more annular grooves formed at an internal surface of sleeve 46. Inlet passages 66 may extend inward to communicate with the grooves. The grooves may be of sufficient size for the fluid to be drawn from the inlet port down toward bushing 30, within sleeve 46, by a gravitational force. Movement of piston 42 (i.e., of narrow diameter sections 54, 56, 58 and wide diameter sections 60, 62) may selectively open or close the grooves to cause movement of piston 42. It is contemplated that inlet passage 66 may be in fluid communication with accumulator membrane 44, in some embodiments, although it is not shown in FIG. 3.

In some embodiments, an annular lift groove 68 may be configured to receive fluid from inlet passage 66 to contact a shoulder A at wide diameter section 60 in order to force piston 42 in an upward direction. Lift groove 68 may be formed as a concentrically arranged passage around piston 42. With this configuration, fluid may flow from the inlet port, through inlet passage 66, into annular groove 68, and into contact with shoulder A. In certain situations, the force of the pressurized fluid against shoulder A may be sufficient to overcome the downward force of piston 42 caused by the nitrogen gas. It is contemplated, however, that, in other situations, the force may not be sufficient to overcome the downward force of piston 42, as shown in FIG. 3.

Also shown in FIG. 3, hammer 12 may be equipped with an automatic shutoff (ASO) system 70. ASO system 70 may include an annular ASO inlet groove 72, an annular ASO outlet groove 74, and an annular passage 78 fluidly connecting ASO inlet groove 72 to ASO outlet groove 74. ASO inlet groove 72, ASO outlet groove 74, and passage 78 may all be formed as a concentrically arranged passages around piston 42. Pressurized fluid may be selectively introduced into ASO inlet groove 72 via inlet passage 66, as will be discussed in more detail below. During an ASO operation (e.g., after work tool 24 breaks through construction material) (shown in FIG. 3), pressurized fluid may be directed from ASO inlet groove 72 to ASO outlet groove 74. The pressurized fluid may contact a lower shoulder 1 at narrow diameter section 56 of piston 42 and an upper shoulder C at narrow diameter section 56 before flowing to one or more outlet passages 76. The pressurized fluid may substantially lock piston 42 in its lowest position and prevent piston 42 from moving upward. Outlet passages 76 may be configured to direct the pressurized fluid through sleeve 44 and into a return tank 82 (shown in FIGS. 4-6).

Figure 4:
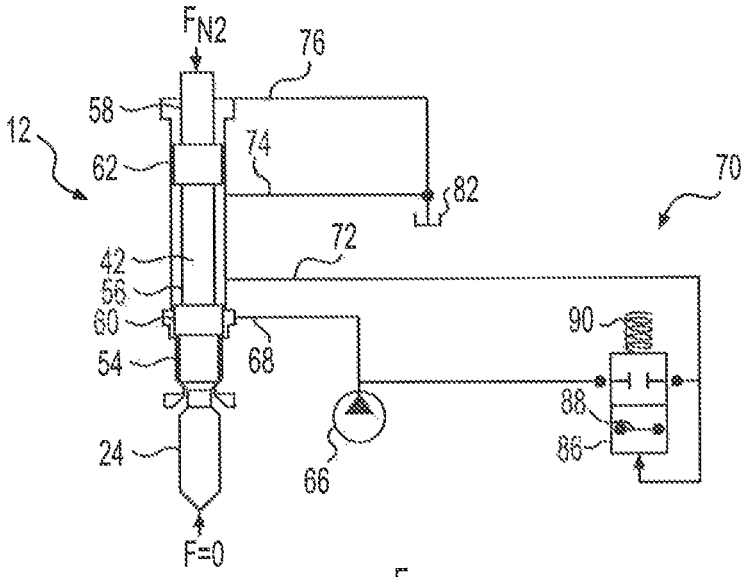
FIGS. 4, 5, and 6 are schematic illustrations of the automatic shutoff system of FIG. 3.
Figure 5:
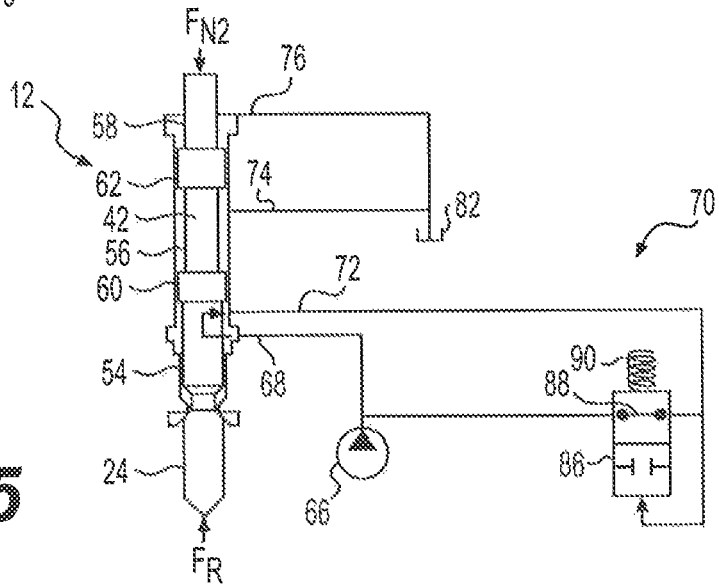
Figure 6:
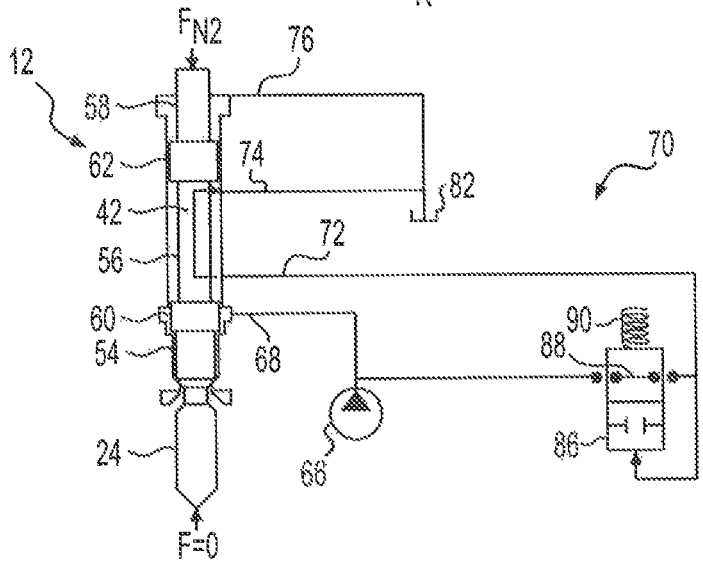

FIGS. 4, 5, and 6 illustrate operation of hammer 12 during different operational steps of piston 42. As shown in FIGS. 4-6, ASO system 70 may also include an ASO valve 86 configured to delay the ASO operation based on an operational state of hammer 12. In particular, ASO valve 86 may be configured to block the flow of pressurized fluid from inlet passage 66 to ASO inlet groove 72 during a non-operating state (e.g., before an initial upward stroke of piston 42). During an operating state (e.g., after the initial upward stroke of piston 42), ASO valve 86 may be configured to allow the flow of pressurized fluid from inlet passage 66 to ASO inlet groove 72. ASO valve 86 may include a movable valve element 88 and a spring 90. Valve element 88 may be configured to move between a flow blocking position (e.g., closed position) and a flow passing position (e.g., open position) in response to a hydraulic pressure level at ASO valve 86. Specifically, when the pressure level is greater than a threshold amount, valve element 88 may be forced to the flow passing position. Alternatively, when the pressure level is below the threshold amount, spring 90 may bias valve element to the flow blocking position. FIGS. 4-6 will be described in more detail below to further illustrate the disclosed concepts.

INDUSTRIAL APPLICABILITY

The disclosed ASO system may be used in any hydraulic hammer application. In particular, ASO system 70 may delay the ASO operation during an initial upward stroke of piston 42 by selectively blocking flow of pressurized fluid between inlet passage 66 and ASO inlet groove 72. Specifically, ASO valve 86 may block the flow of pressurized fluid between inlet passage 66 and ASO inlet groove 72. Operation of hammer 12 will now be described in detail.

Referring to FIG. 4, before the initial upward stroke of piston 42, valve element 88 of ASO valve 86 may be biased in the closed position via spring 90, thereby blocking the flow of fluid from inlet passage 66 to ASO inlet groove 72. In this operational state, an ASO operation may be turned off.

After an operator request is made to begin operation of hammer 12, hammer 12 may receive pressurized fluid, for example pressurized oil, at inlet passage 66. The oil may flow down inlet passage 66 and be drawn by force of pressure axially downward toward a tip of piston 42 (i.e. toward impact end 64) and be directed inward into lift groove 68. A sufficient amount of oil within lift groove 68 may apply an upward pressure on piston 42. Specifically, the oil within lift groove 68 may apply pressure to shoulder A of wide diameter section 60 and bias piston 42 upward.

Referring to FIG. 5, movement of piston 42 upward may open ASO inlet groove 72. Specifically, movement of piston 42 upward may correspondingly move narrow diameter section 54 to a location adjacent to ASO inlet groove 72. While ASO inlet groove 72 is uncovered, pressurized fluid may flow from lift groove 68 into ASO inlet groove 72, causing valve element 88 to be pressurized above the threshold amount and be moved into the flow passing position. Subsequently, pressurized fluid from inlet passage 66 may be allowed to flow to ASO inlet groove 72, and ASO operation may be turned on.

After the initial upward stroke, movement of piston 42 toward valve 50 may also cause narrow diameter section 58 to reduce the size of the gas chamber. This reduction in size may further pressurize nitrogen gas within the gas chamber, thereby biasing piston 42 downward and away from valve 50. Such biasing may increase the pressure downward on piston 42, causing piston 42 to accelerate downward and contact work tool 24. Piston 42 may continue to reciprocate up and down in response to the nitrogen gas and the oil.

Once work tool 24 is no longer in contact with construction material (e.g., breaks through the construction material), piston 42 may drop down to its lowest position. While in this position, pressurized fluid may flow from ASO inlet groove 72 to ASO outlet groove 74 via passage 78. The pressurized fluid may apply force against shoulders B and C of narrower diameter section 56, and lock piston 42 in its lowest position.

Pressurized fluid may continue to flow within sleeve 44 and be removed through outlet passage 76 and returned to tank 82. After oil has been removed from inlet passage 66, the pressure level at ASO valve 86 may be less than the threshold amount. In response to this pressure level, valve element 88 of ASO valve 86 may be biased to return to the flow blocking position via spring 90, and ASO operation may once again be turned off, as shown in FIG. 4.

The present disclosure may provide an ASO system 70 for a hydraulic hammer 12 that delays an ASO operation for an initial upward stroke of piston 42. This delay may cause the ASO operation to be turned off for the start of hammer operation, thus preventing machines from being stuck in the ASO operation. As a result, unnecessary downtime of the machines may be avoided.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. An automatic shutoff system for a hydraulic hammer, comprising:

an inlet groove formed annularly around a piston associated with the hydraulic hammer and configured to receive pressurized fluid;

an outlet groove formed annularly around the piston associated with the hydraulic hammer and configured to discharge the pressurized fluid;

an annular passage configured to allow the pressurized fluid to flow between the inlet and outlet grooves; and a valve disposed upstream of the inlet groove and configured to selectively block the pressurized fluid from flowing into the inlet groove based on an operational state of the hydraulic hammer.

2. The automatic shutoff system of claim 1, wherein the operational state is relative to an initial upward stroke of the piston associated with the hydraulic hammer.

3. The automatic shutoff system of claim 2, wherein the valve blocks fluid from flowing into the inlet groove before the initial upward stroke of the piston.

4. The automatic shutoff system of claim 2, wherein the valve allows fluid to flow into the inlet groove after the initial upward stroke of the piston.

5. The automatic shutoff system of claim 4, wherein, when the piston falls to its lowest position, the flow of pressurized fluid between the inlet and outlet grooves locks the piston in the lowest position.

6. The automatic shutoff system of claim 2, wherein the valve includes:

a valve element configured to move between a flow blocking position and a flow passing position; and a spring configured to bias the valve element to the flow blocking position.

7. The automatic shutoff system of claim 6, wherein the valve element is moved to the flow passing position when a pressure level at the valve is greater than a threshold amount.

8. The automatic shutoff system of claim 7, wherein the valve element is moved to the flow passing position during the initial upward stroke of the piston.

9. The automatic shutoff system of claim 6, wherein the valve element is biased to the flow blocking position when a pressure level at the valve is less than a threshold amount.

10. A method of operating a hydraulic hammer, comprising:

receiving pressurized fluid at an inlet groove;

providing fluid communication between the inlet groove and an outlet groove via an annular passage connecting the inlet groove to the outlet groove;

discharging the pressurized fluid from the outlet groove; and selectively blocking a flow of the pressurized fluid between the inlet and outlet grooves based on an operational state of the hydraulic hammer.

11. The method of claim 10, wherein selectively blocking the flow of the pressurized fluid includes blocking fluid between the inlet and outlet grooves before an initial upward stroke of a piston associated with the hydraulic hammer.

12. The method of claim 10, wherein selectively blocking the flow of the pressurized fluid includes allowing fluid between the inlet and outlet grooves after an initial upward stroke of a piston associated with the hydraulic hammer.

13. The method of claim 12, further including locking the piston in its lowest position by allowing the flow of pressurized fluid between the inlet and outlet grooves.

14. The method of claim 10, wherein selectively blocking the flow of the pressurized fluid includes blocking fluid between the inlet and outlet grooves when a pressure level is less than a threshold amount.

15. The method of claim 10, wherein selectively blocking the flow of the pressurized fluid includes allowing fluid between the inlet and outlet grooves when a pressure level is greater than a threshold amount.

16. A hydraulic hammer system, comprising:

a piston;

a sleeve disposed external and co-axial to the piston;

a plurality of inlet passages formed within the sleeve and configured to receive pressurized fluid;

an inlet groove formed annularly at an internal surface of the sleeve and fluidly connected to the plurality of inlet passages;

an outlet groove formed annularly at an internal surface of the sleeve and fluidly connected to the inlet groove;

an annular passage configured to allow the pressurized fluid to flow between the inlet and outlet grooves; and an automatic shutoff system including a valve configured to delay an automatic shutoff operation based on an operational state of the hydraulic hammer.

17. The hydraulic hammer of claim 16, wherein the valve is located upstream of the inlet groove and configured to selectively block the pressurized fluid from flowing into the inlet groove based on an initial upward stroke of the piston, the valve including:

a valve element configured to move between a flow blocking position and a flow passing position; and a spring configured to bias the valve element to the flow blocking position.

18. The hydraulic hammer of claim 16, wherein the valve element is in the flow blocking position before the initial upward stroke of the piston.

19. The hydraulic hammer of claim 16, wherein the valve element is in the flow passing position after the initial upward stroke of the piston.

20. The automatic shutoff system of claim 16, wherein the valve element is moved to the flow passing position when a pressure level at the valve is greater than a threshold amount.

* * * * *